United States Patent [19]

Maekawa et al.

[11] 4,234,948

[45] Nov. 18, 1980

[54] WATCHGLASS FIXING STRUCTURE

[75] Inventors: Yasuo Maekawa; Tsunetoshi Sekiguchi, both of Tokyo; Masahiko Waki, Tokorozawa; Hiroshi Koide, Tokyo; Kisuke Watanabe, Tokyo; Osamu Matsumura, Chofu; Hisao Yamagata, Tokorozawa, all of Japan

[73] Assignee: Citizen Watch Co., Ltd., Tokyo, Japan

[21] Appl. No.: 893,686

[22] Filed: Apr. 5, 1978

[30] Foreign Application Priority Data

| | | | |
|---|---|---|---|
| Apr. 6, 1977 | [JP] | Japan | 52-39353 |
| Jul. 9, 1977 | [JP] | Japan | 52-82265 |
| Nov. 4, 1977 | [JP] | Japan | 52-131475 |
| Nov. 4, 1977 | [JP] | Japan | 52-131476 |
| Nov. 5, 1977 | [JP] | Japan | 52-132825 |
| Nov. 7, 1977 | [JP] | Japan | 52-133280 |
| Nov. 17, 1977 | [JP] | Japan | 52-138131 |
| Dec. 23, 1977 | [JP] | Japan | 52-155136 |
| Dec. 27, 1977 | [JP] | Japan | 52-156440 |

[51] Int. Cl.[3] ..... G04B 37/08; G04B 39/02

[52] U.S. Cl. ..... 368/291; 368/294; 368/309

[58] Field of Search ..... 58/53–55, 58/88 R, 90 R, 91; 73/431; 206/301, 18, 70, 810

[56] References Cited

U.S. PATENT DOCUMENTS

| | | | |
|---|---|---|---|
| 2,308,189 | 1/1943 | Marti | 58/91 |
| 3,020,703 | 2/1962 | Wadsworth | 58/90 R |
| 4,110,970 | 9/1978 | Fudázawa et al. | 58/90 R |
| 4,117,658 | 10/1978 | Miyasaka et al. | 58/90 R |
| 4,136,515 | 1/1978 | Thompson et al. | 58/90 R |

FOREIGN PATENT DOCUMENTS

| | | | |
|---|---|---|---|
| 473418 | 7/1969 | Switzerland | 58/90 R |

*Primary Examiner*—Edith S. Jackmon

[57] ABSTRACT

A structure for fixing a watchglass of a watch case, which comprises a watchglass fixing member having a ring-shaped recess and a flange formed at an upper portion of said recess, a watchglass having an outer diametric surface formed with an inclined guiding surface below said outer diametric surface, and a synthetic resin ring disposed in said recess of said watchglass fixing member and sandwiched between said recess and said watchglass and having a protrusion formed when said watchglass is press fitted into said synthetic resin ring, said protrusion serving as means for retaining said watchglass in a fixed place.

9 Claims, 27 Drawing Figures

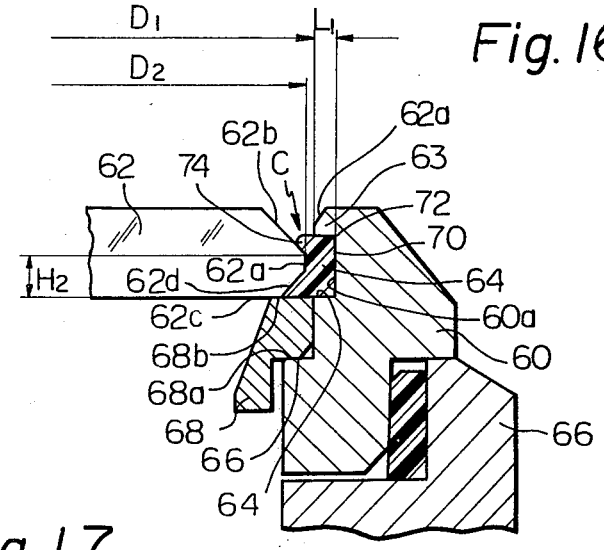
Fig. 16
Fig. 17
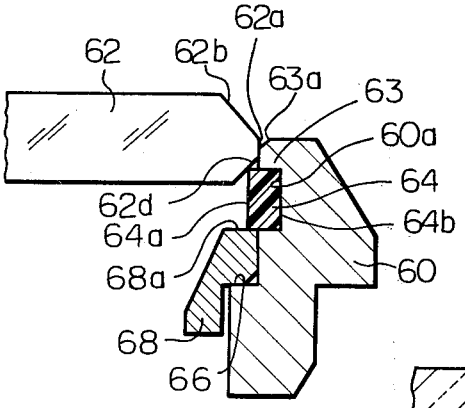
Fig. 18
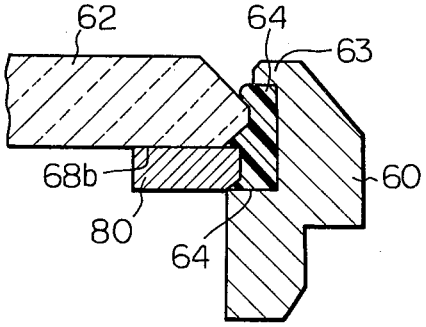

Fig. 21
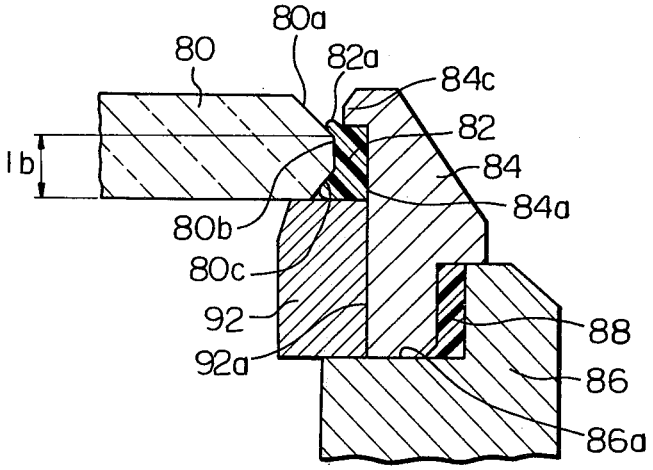
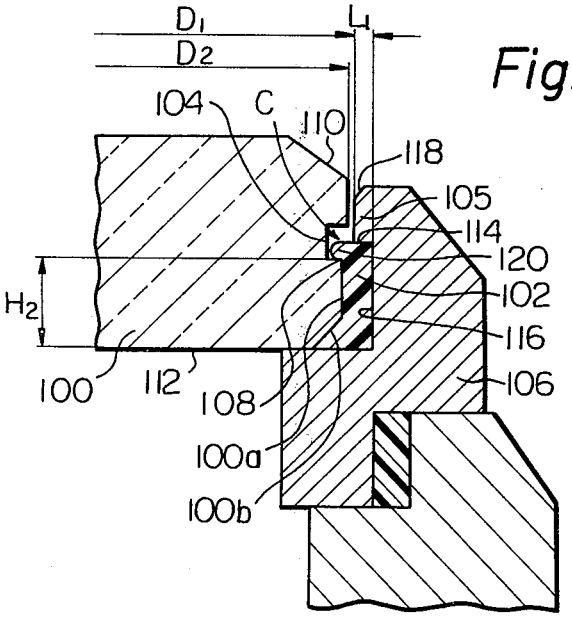
Fig. 22

WATCHGLASS FIXING STRUCTURE

This invention relates to a watch case and, more particularly, to a mounting structure for fixedly retaining the watchglass of a timepiece.

A conventional structure for fixing a watchglass made use of a synthetic resin packing ring. The synthetic resin packing ring is compressed between the outer circumference of a watchglass and the inner circumference of a case band, whereby the watchglass and packing are fixed against axial movement by the frictional force existing between them, while the packing ring and case band are fixed against axial movement by the frictional force existing between them. Since the fixing force between the packing ring and case band in this instance is greater than that between the watchglass and the packing ring, the force which fixes the watchglass against axial movement is decided by the frictional force between the watchglass and the packing ring, hence, the packing ring must be subjected to a large compressing force in the direction of its diameter in order to provide a sufficient fixing force and water-tight seal over a long period of time. However, when a large amount of compression is applied, the packing ring protrudes excessively in the upward direction at the time that it is press-fitted about the outer circumference of the watchglass. It is therefore not possible to obtain reliable fixing force and waterproofness.

In another prior art, a watchglass and case band sandwich and compress a synthetic resin packing ring the height of which is greater than that of the vertical portion of the outer circumference of the watchglass and the vertical portion of the inner circumference of the case band. The upper portion of the packing ring extends up onto the inclined surface of the watchglass and the inclined surface of the case band, thereby pressuring the watchglass and fixing it against movement in both the diametric and axial directions. In this case, the watchglass is fixed against axial movement by virtue of the upper portion of the packing ring which has crept over the inclined surface of the watchglass as well as the thickened portion of the packing ring. At a glance the present structure provides slightly greater reliability in terms of fixing force than that of the firstly mentioned prior art, but a closer inspection will reveal that the fixing force with respect to the upper part of the watchglass is determined by the bending strength primarily of the upper portion of the synthetic resin packing ring which, since it possesses resiliency, does not provide the necessary fixing force.

Neither of the examples of the prior art provide stable fixing power or waterproofness, and both require a large amount of trim due to the considerable thickness of the packing about the circumference of the watchglass, a defect which places severe restrictions upon design. In particular, the secondly mentioned prior art drastically limits design since the upper portion of the packing ring spreads and widens.

The present invention seeks to overcome the above-mentioned problems encountered in the prior art.

It is, therefore, an object of the present invention to provide an improved mounting structure for timepiece components.

It is another object of the present invention to provide a mounting structure adapted to fixedly retain a watchglass onto a bezel or case band of a timepiece.

It is another object of the present invention to provide a mounting structure for a timepiece, which structure provides a reliable fixing force and waterproofness.

These and other objects, features and advantages of the present invention will become more aparent from the following description when taken in conjunction with the accompanying drawings, in which:

FIG. 16 is a cross section of another preferred embodiment of a mounting structure for a timepiece according to the present invention;

FIG. 17 is a cross section of the structure shown in FIG. 16 during assembly;

FIG. 18 is a cross section of a modified form of the structure shown in FIG. 16;

FIG. 21 is a cross section showing a modification of the structure shown in FIG. 20;

FIG. 22 is a cross section of still another preferred embodiment of a mounting structure for a timepiece according to the present invention;

Figure 1:
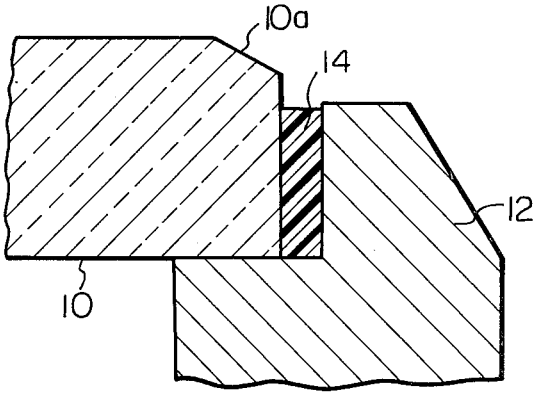
Fig. 1 PRIOR ART
FIG. 1 is a cross sectional view of a prior art mounting structure for a timepiece.

FIG. 1 shows a typical example of structures adapted to fix a watchglass to a watchglass fixing member such as a watchglass bezel or case band through the intermediary of a synthetic resin ring. In FIG. 1, a watchglass 10 is press-fitted into the stepped portion of a case band 12 through the intermediary of a synthetic resin ring 14. Owing to the excellent plasticity, heat-resistance and chemical resistance of the synthetic resin, the watchglass fixing structure of this type has come into widest use. Based upon experience, such a structure requires that the height of the ring be at least 1.2 mm in order to maintain the fixing force and water-tight seal between the watchglass and case band; a height of less than 1.2 mm does afford the intended function. Moreover, the thickness of the watchglass in actual practice is limited to 1.3 mm since an upper inclined surface 10*a* must be adopted in order to enhance appearance and prevent breakage. However, since modern mechanical watch movements now possess a thickness of only 2 to 3 mm and electronic watch movements a thickness of 3 to 4 mm, there is an increasing need to produce ever thinner and more compact watch cases as well.

The structure of the present invention was devised in view of the abovementioned requirements and seeks to minimize watch case thickness by making it possible to fix a watchglass of a thickness as small as 0.4 to 1.2 mm, representing an epochmaking thickness reduction in comparison to the prior art, to a watch glass fixing member such as a bezel or case band.

More specifically, the conventional synthetic ring was disposed between and embraced by the watchglass and case band, whereby frictional force provided the fixing force and waterproofness between the watchglass and ring as well as between the ring and case band. However, when the synthetic ring was compressed in the diametric direction it underwent elastic and plastic deformation directed along its upper edge. As a result, this was accompanyed by a corresponding decrease in the force applied to the case band and watchglass so that a strong fixing force and reliable water-tight seal could not be obtained.

The inventors have conducted extensive experiments relating to the abovementioned problems and have discovered the following facts:

(1) The water-tight seal between the watchglass and synthetic resin ring can be assured if the outer circumference of the watchglass possesses even a small straight outer diametric surface.

(2) A water-tight seal and fixing force which are greater than expected are obtained at the outer diametric surface of the watchglass and inner circumferential surface of the case band if the synthetic resin ring is subjected to volume compression.

(3) The watchglass fixing force is greatly enhanced when a portion of the synthetic resin ring, in the volume compressed state, is allowed to protrude through a small clearance and cover a portion of the upper inclined surface of the watchglass.

The present invention was perfected based upon the results of these findings and constitutes the structure of a watchglass portion comprising a watchglass fixing member having an annular groove on its inward side the upper portion of which includes a flange and the lower portion of which groove is equipped with a watchglass seating surface; a watchglass having an outer diametric surface the height of the vertical portion of which is lower than the height of the inner surface at the upper portion of the annular groove while the outer diameter of the watchglass is slightly shorter than the inner diameter of the flange, and an inclined guiding surface at the portion below the outer diametric surface; and a synthetic resin ring sandwiched between the annular groove and watchglass and having a protruded portion formed by protrusion from a space between the vertical portion of the watchglass and the annular groove. This provides a thin, compact watch case which makes it possible to fix an extremely thin watchglass to a bezel or case band, etc.

A more detailed description of the present invention will now be had with reference to the accompanying drawings.

Figure 2:
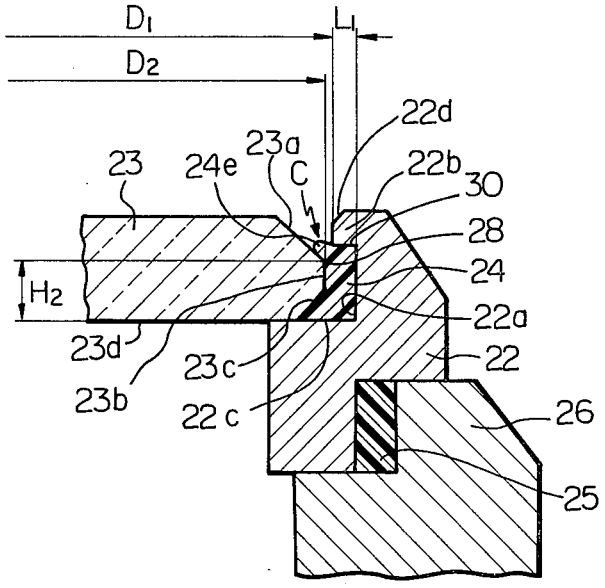
FIG. 2 is a cross section of a preferred embodiment of a mounting structure for a watchglass of a timepiece according to the present invention.
Figure 3:
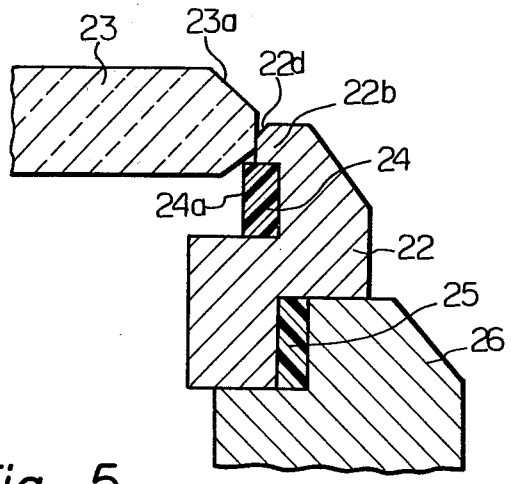
FIG. 3 is a cross section of the mounting structure shown in FIG. 2 during assembly.

FIGS. 2 and 3 depict embodiments of the present invention in which reference numeral 22 denotes a watchglass bezel which serves as a watchglass fixing body, 23 a watchglass, 24 a synthetic resin ring, 25 a sealing ring and 26 a case band. The inner circumferential surface of bezel 22 is formed to include an inwardly facing annular or ring-shaped recess 22*a* for accommodating the synthetic resin ring 24, an inwardly projecting ring-shaped flange 22*b* for compressing the upper edge of the ring 24, and a ring-shaped watchglass seating surface 22*c* for seating the bottom surface of the watchglass 23. The upper surface of flange 22*b* is formed to include an inclined surface 22*d* which facilitates the installation of the watchglass. The depth $L_1$ of the annular recess 22*a* is selected such that the compressed portion of the synthetic resin ring partially protrudes between a slanted wall 23*a* of the watchglass and the edge of flange 22*b* of bezel 22 to firmly retain the watchglass 23 in place. The inner diameter $D_1$ of flange 22*b* is slightly larger than the outer diameter $D_2$ of watchglass 23 in order to serve as a guide when installing the watchglass.

Figure 4:
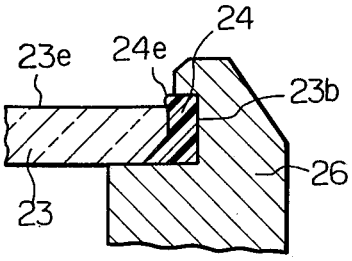
FIG. 4 is a modified form of the mounting structure shown in FIG. 2.

Meanwhile, the outer circumference of watchglass 23 includes a substantially vertical outer diametric surface 23*b* below which is formed an inclined surface 23*c* that serves as a guide when the watchglass is inserted within the synthetic resin ring 24. The outer diameter $D_2$ of the outer diametric surface 23*b* is slightly less than the inner diameter of flange 22*d* of the bezel 22 and is designed so as to compress the ring 24. The vertical portion 28 at the intersection of the outer diametric surface 23*b* and upper inclined surface 23*a* is formed so that the distance $H_2$ from portion 28 to the bottom surface 23*d* of the watchglass is at a lower level than the inner surface 30 at the upper portion of annular recess 22*a*, whereby a clearance C is formed between the inner surface 30 and the edge between the slanted wall 23*a* of watchglass and vertical portion 23*b*. The point of intersection or edge between the inclined guiding surface 23*c* and the bottom surface 23*d* of the watchglass is positioned further inward than the inner surface 24*a* of the synthetic resin ring 24. This prevents the edge of the watchglass from pulling the ring during the press-fitting of the glass and mitigates the resistance offered by the glass. The upper inclined surface 23*a* of the watchglass is necessary for the sake of appearance and also prevents splintering of the glass. However, according to one object of the present invention, the outer diametric surface 23*b* of the watchglass may be jointed directly to the top surface 23*e* without the intermediary of an inclined portion, as can be seen in FIG. 4.

Figure 5:
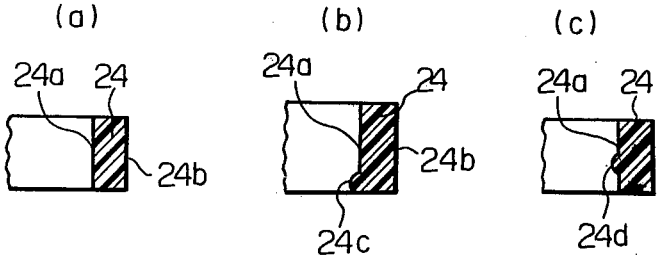
FIG. 5 shows examples of a synthetic resin ring to be used for the structure shown in FIG. 2.

In FIG. 5(*a*) the synthetic resin ring 24 has an I-shaped cross-section prior to assembly. The inward side of the ring includes an inner surface 24*a* which is compressed by the outer diametric surface 23*b* of the watchglass 23, which the outer side includes an outer surface 24*b* which contacts the bottom of the annular recess 22*a* of the bezel 22. The height of the ring in this case is the same as or slightly lower than that of the annular groove. Shown in FIG. 5(*b*) is a synthetic resin ring 24 the lower portion of which is equipped with a bulge 24*c* adapted to creep under the inclined guiding surface 23*c* of the watchglass 23. FIG. 5(*c*) shows another example in which the inner surface 24*a* of the ring is provided with a bulge 24*d*.

The synthetic resin ring 24 is forcibly compressed in the space defined by the annular groove 22*a*, outer diametric surface 23*b* and inclined guiding surface 23*c*. Owing to the plasticity of the resin, the entire space is filled to ensure a waterproof state and provide the fixing force for the watchglass. Further, the intense volume compression causes a portion of the synthetic resin ring 24 to protrude from the clearance C and form protrusion 24*e*, the upper inclined surface 23*a* of the watchglass being pressed in the downward direction by the protrusion 24*e*.

The assembly proceeds as follows. As shown in FIG. 3, the synthetic resin ring 24 is disposed in the annular recess 22*a* of watchglass bezel 22. Once the watchglass 23 is disposed at a position where it can be guided by flange 22*b* and inclined surface 22*d*, the glass is pressed downward by means of a jig and comes into uniform pressured contact with the inner surface 24*a* of the ring 24, the glass being assisted by the flange 22*b* so as to approach from the correct position. Finally, as shown in FIG. 2, a portion of the synthetic resin ring 22 protrudes from the clearance C and forms the protrusion 24*e* on the upper inclined surface 23*a*, thereby greatly enhancing the force which fixes the watchglass 23.

The results of an experiment shown in the following table relate to fixing force and waterproofness of a watchglass designed and tested on the basis of the structure shown in FIG. 2. For reference the table also includes the results of an experiment conducted using a structure illustrated in FIG. 6, wherein a watchglass 40 was press-fitted in a synthetic resin ring 42 disposed in the stepped portion of a case band 44. The structures depicted in FIGS. 2 and 6 made use of the same watchglass as well as an identical synthetic resin (Teflon) ring and ring compressibility. The test to determine waterproofness was conducted at a pressure of 4 Atm. for 10 minutes.

Figure 6:
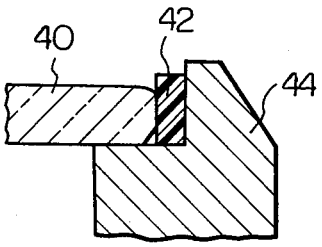
Fig. 6 PRIOR ART
FIG. 6 is a cross section of a prior art mounting structure.

| | Structure according to present invention as shown in FIG. 2 | | Structure according to example as shown in FIG. 6 | |
|---|---|---|---|---|
| Sample No. | Fixing force | waterproofness | Fixing force | Waterproofness |
| 1 | 17kg | good | 5.5kg | good |
| 2 | 15kg | ↑ | 4kg | Glass fogged: unsatisfactory |
| 3 | 21kg | ↑ | 8kg | good |
| 4 | 13kg | ↑ | 4.5kg | Glass fogged: unsatisfactory |
| 5 | 16kg | ↑ | 7.5kg | good |
| 6 | 25kg | ↑ | 5kg | ↑ |
| 7 | 18kg | ↑ | 6.5kg | ↑ |
| 8 | 20kg | ↑ | 6.5kg | ↑ |
| 9 | 17kg | ↑ | 8.5kg | ↑ |
| 10 | 21kg | ↑ | 7kg | ↑ |
| Average | 18.3kg (Fixing force offered no problems during actual use | | 6.3kg (Fixing force led to problems during actual use) | |

It is clear from these experimental results that the structure of the present invention affords waterproofness and fixing force far superior to that of the prior art. Moreover, experiments conducted with regard to the 3rd fact mentioned above revealed that it was possible to reduce the thickness of the watchglass to 0.4 mm. This is an epoch-making accomplishment in view of the fact that the prior art structure could not make use of a watchglass having a thickness of less than 1.2 mm.

Although the synthetic resin ring utilized in the experiments was made of Teflon, any material exhibiting suitable plastic characteristics may be used. Teflon is the most appropriate owing to its extremely high degrees of plasticity, but other suitable materials are nylon 11, nylon 12, Tefzel, Pelpren, Aflon, polyethylene and polycarbonate.

In the present invention, a watchglass bezel is provided with an annular recess which fixes the watchglass, as shown in FIG. 2. However, it is also possible to adopt the structure of FIG. 4 in which the recess for fixing the watchglass is provided in a case band which will therefore serve as the watchglass fixing member. It is of course possible to adopt the structure of the present invention when attaching other external components such as a watchglass bezel, back cover, battery hatch, etc.

Since the present invention is a structure wherein a synthetic resin ring is forcibly compressed between a watchglass and the annular recess of a watchglass fixing member such as a bezel or case band so that a portion of the ring protrudes from a clearance between the watchglass and annular groove to form a protrusion, the force which fixes the watchglass and the water-tight seal between the watchglass and its fixing member can both be greatly enhanced. On the other hand, the structure of the prior art merely compresses a synthetic resin ring in the diametric direction, so that much of the fixing force is lost due to deformation in the upward direction. In order to maintain the fixing force and water-tight seal at this portion, it is necessary to increase the thickness of the watchglass and the height of the ring etc. The present invention, however, adopts a completely different structure in which the synthetic resin ring is forcibly compressed in an annular recess which further gives rise to a deformed portion that is squeezed out of a clearance to form a protrusion on the upper inclined surface of the watch glass. Fixing force and waterproofness superior to that of the prior art can therefore be obtained even when using an extremely small ring and a thin watchglass. The structure of the present invention accordingly sufficiently meets the demand for thinner, more compact modern watch cases.

FIGS. 7 through 10 show another preferred embodiment of a watchglass fixing structure according to the present invention, with like parts bearing the same reference numerals as those used in FIGS. 2 through 4. In this illustrated embodiment, the synthetic resin ring 24 has an L-shaped cross-section prior to assembly. The upper portion of the inward side of the ring includes an inner surface 24*a* which is compressed by the outer diametric surface 23*b* of the watchglass 23, while the outer side includes an outer surface 24*b* which contacts the bottom of the annular recess 22*a* of bezel 22. The upper surface 24*f* of an inwardly directed projection 24*g* serving as a dumper to prevent the glass 23 from being damaged when it is assembled to the watch case is adapted to seat the outer circumferential portion at the bottom surface of the watchglass 23. The height of the ring in this case is the same as or slightly lower than that of the annular recess.

The synthetic resin ring 24 is forcibly compressed in the space defined by the annular recess 22*a*, outer diametric surface 23*b* and inclined guiding surface 23*c*. Owing to the plasticity of the resin, the entire space is filled to ensure a waterproof state and provide the fixing force for the watchglass. Further, the intense volume compression causes a portion of the synthetic resin ring 24 to protrude from the clearance C and form a protrusion 24*e*, the upper inclined surface 23*a* of the watchglass being pressed in the downward direction.

Figure 7:
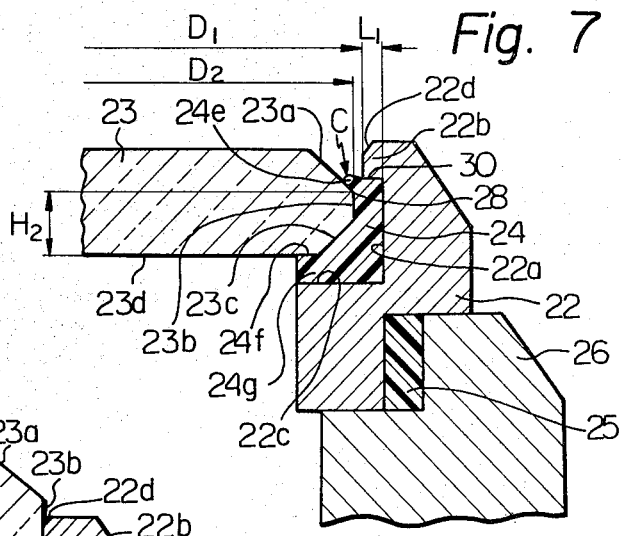
FIG. 7 is a cross section of a modified form of the mounting structure shown in FIG. 2.
Figure 8:
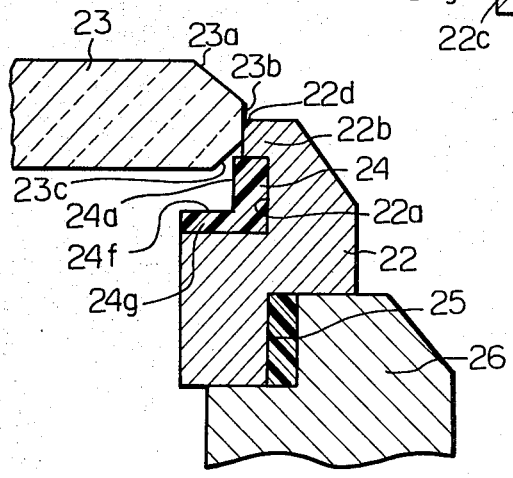
FIG. 8 is a cross section of the mounting structure shown in FIG. 7 during assembly.
Figure 9:
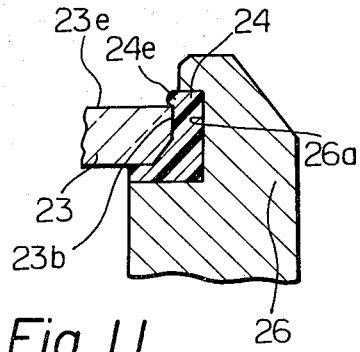
FIG. 9 is a cross section of the structure shown in FIG. 7.
Figure 10:
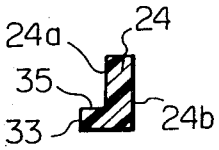
FIG. 10 is a cross section of a synthetic resin ring shown in FIGS. 7 and 8.

FIG. 9 shows a modification of the assembly shown in FIG. 7. In this modification, the case band 26 is formed with an annular recess 26*a* in which the ring 24 is disposed to retain the glass plate 23 in a fixed place.

Figure 11:
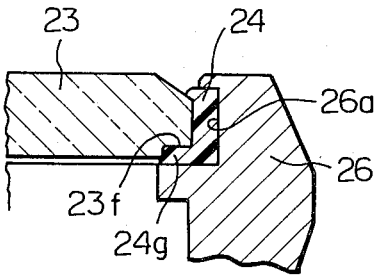
FIG. 11 is a cross section of a modification of the mounting structure shown in FIG. 7.

FIG. 11 shows another modification of the assembly shown in FIG. 7. In this modification, the glass plate 23 has on its lower surface a ring-shaped shoulder 23*f* adapted to hold the projection 24*g*.

Figure 12:
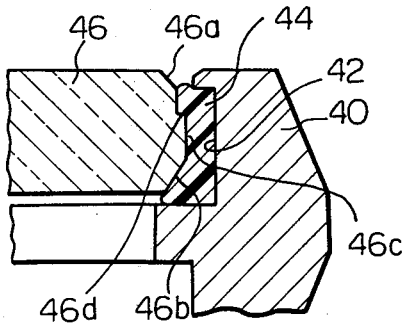
FIG. 12 is a cross section of another modification of the structure shown in FIG. 7.

FIG. 12 shows still another modified form of the assembly shown in FIG. 2. In this modification, a case band 40 has a ring-shaped recess 42 in which a synthetic resin ring 44 is disposed. A watchglass 46 has an upper slanted surface 46*a*, a lower slanted surface 46*b*, a vertical surface 46*c*, and a ring-shaped shoulder 46*d* formed between surface 46*a* and 46*c* to partially accommodate an upper, inward portion of the ring 42 by which the watchglass is retained.

Figure 13:
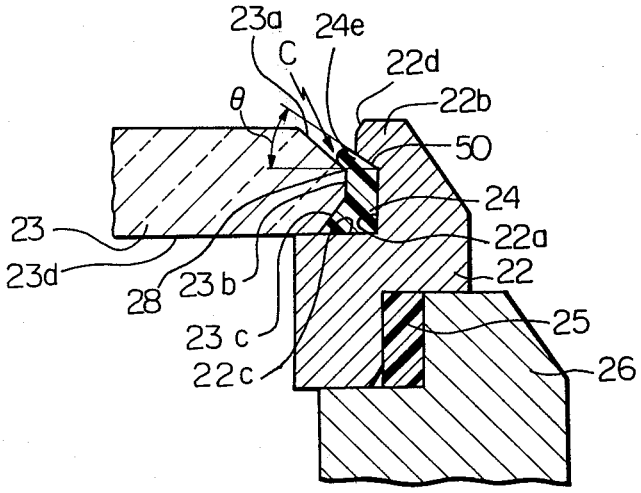
FIG. 13 is a cross section of another modified form of the structure shown in FIG. 7.
Figure 14:
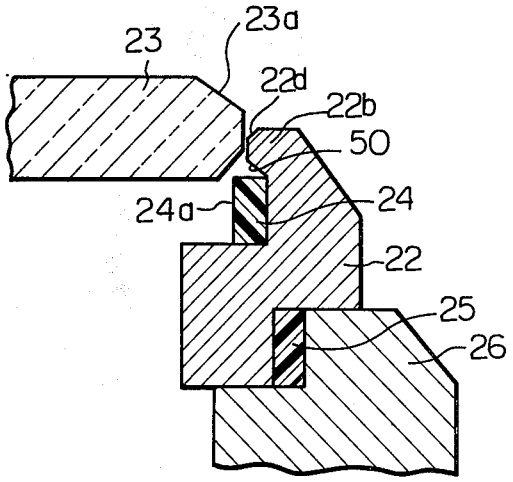
FIG. 14 is a cross section of the structure shown in FIG. 13 during assembly.

FIGS. 13 and 14 show still another modified form of the assembly shown in FIG. 2, with like parts bearing the same reference numerals as those used in FIG. 2. In this modification, the upper part of the annular recess 22*a* has an inclined surface 50 inclined at an angle $\theta$ to facilitates the installation of the ring 24 and the formation of a protrusion 24*e*. FIG. 14 shows a state before the watch glass 23 is inserted to the ring 24. Other parts are identical to those shown in FIG. 2 and therefore a detailed description of the same is omitted.

Figure 15:
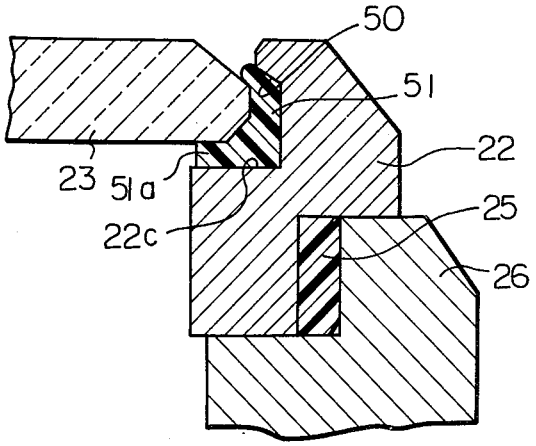
FIG. 15 is a cross section of the structure shown in FIG. 13.

FIG. 15 shows a modification of the structure shown in FIG. 13. In this modification, the synthetic resin ring 51 has an inwardly directed projection 51*a*, which is compressed between the watch glass 23 and the shoulder 22*c* of the bezel 22.

FIGS. 16 and 17 depict another preferred embodiment of the present invention in which reference numeral 60 denotes a watchglass bezel which serves as a watchglass fixing member, 62 a watchglass, 64 a synthetic resin ring, 66 a case band, and 68 an inner ring member for seating the bottom surface of the watchglass 62. The inner circumferential surface of bezel 60 is formed to include an annular recess 60*a* for accommodating the synthetic resin ring 64. The upper portion of the bezel 60 includes a flange 63 for compressing the ring 64, and the lower portion includes a synthetic resin ring seating portion 64 below which is formed a ring-shaped stepped portion 66 adapted to seat the inner ring member 68. The upper surface of flange 63 is formed to include an inclined surface 63*a* which facilitates the installation of the watchglass. The depth $L_1$ of the annular recess is approximately equal to the amount of inward protrusion of the compressed portion of the synthetic resin ring, and the inner diameter $D_1$ of flange 63 is slightly longer than the outer diameter $D_2$ of watchglass 62 in order to serve as a guide when installing the watchglass. The bottom part of inner ring 68 includes a seating surface 68*a* which rests on the stepped portion 66 of the bezel 60, and the upper part includes a watchglass seating surface 68*b* adapted to seat the bottom surface of the watchglass 62, the levels of the watchglass seating surface 68*b* and synthetic resin ring seating surface 64 being in substantially perfect agreement.

Meanwhile, the outer circumference of watchglass 62 includes a substantially vertical outer diametric surface 62*a* below which is formed an inclined surface 62*b* that serves as a guide when the watchglass is inserted within the synthetic resin ring. The outer diameter $D_2$ of the outer diametric surface 62*a* is slightly shorter than the inner diameter $D_1$ of flange 63 of bezel 60 and is designed to compress the ring 64. The vertical portion 70 at the intersection of the outer diametric surface 62*a* and upper inclined surface 62*b* is formed so that the distance $H_2$ from portion 70 to the bottom surface 62*c* of the watchglass 62 is at a lower level than the inner surface 72 at the upper portion of annular recess 60*a*, whereby a clearance C is formed between the inner surface 72 and the vertical portion 70. The point of intersection between the inclined guiding surface 62*d* and the bottom 62*c* of the watchglass is positioned further inward than the inner surface 64*a* of the synthetic resin ring 64. This prevents the edge of the watchglass from pulling the ring during the press fitting of the glass and mitigates the resistance offered by the glass.

In FIG. 17 the synthetic resin ring 64 has an I-shaped cross-section prior to assembly. The inward side of the ring includes an inner surface 64*a* which is compressed by the outer diametric surface 62*a* of the watchglass 62, while the outer side includes an outer surface 64*b* which contacts the bottom of the annular recess 60*a* of the bezel 60. The height of the ring in this case is the same as or slightly lower than that of the annular groove.

The synthetic resin is forcibly compressed in the spaced defined by the annular recess 60*a*, outer diametric surface 62*a* and inclined guiding surface 62*d*. Owing to the plasticity of the resin, the entire space is filled to ensure a waterproof state and provide the fixing force for the watchglass. Further, the intense volume compression causes a portion of the synthetic resin ring 64 to protrude from the clearance C and form a protrusion 74, the upper inclined surface 62*b* of the watchglass being pressed in the downward direction.

The assembly proceeds as follows. As shown in FIG. 17, the ring member 68 is disposed in the stepped portion 66 of the watchglass bezel 60 from above, and the synthetic resin ring 64 is then placed in the annular recess 60*a* of the bezel. Once the watchglass is disposed at a position where it can be guided by flange 63 and inclined surface 63*a* the glass is pressed downward by means of a jig and comes into uniform pressured contact with the inner surface 64*a* of the ring 64, the glass being assisted by the flange 63 so as to approach from the correct position. Finally, as shown in FIG. 16, a portion of the synthetic ring 64 protrudes from the clearance C and forms the protrusion 74 on the upper inclined surface 62*b*, thereby greatly enhancing the force which fixes the watchglass 62 and strongly securing the inner ring 68 to the bezel 60.

FIG. 18 is a cross-sectional view of a modified form of the watchglass portion shown in FIG. 16. In FIG. 18, the synthetic resin ring seating surface 64 of bezel 60 also serves as means for seating inner ring member 80; hence, the step of working the stepped portion can be eliminated. The assembly proceeds as described above.

Figure 19:
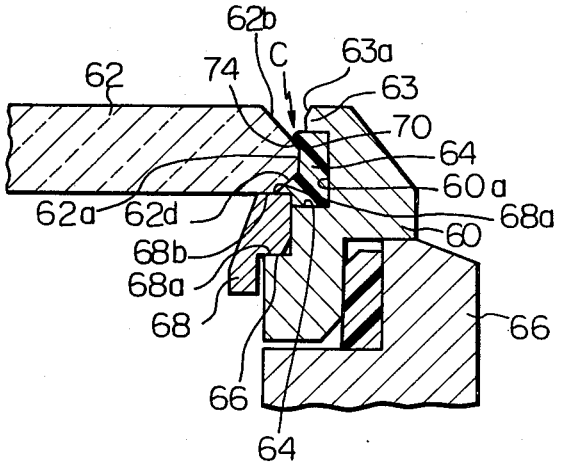
FIG. 19 is a cross section of a modification of the structure shown in FIG. 16.

While, in FIG. 17, an upper wall of the inner ring member 68 is aligned with a lower radial wall of the recess 64*b*, the inner ring member 68 may be arranged such that the upper wall 68*a* engages the bottom wall of the watchglass at a positioned displaced from the lower radial wall of the recess 64*a* as shown in FIG. 19.

Figure 20:
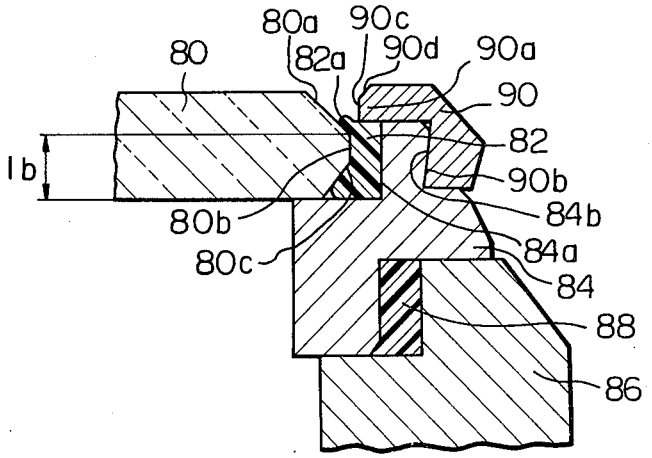
FIG. 20 is a cross section of another preferred embodiment of a mounting structure for a timepiece according to the present invention.

FIG. 20 shows another preferred embodiment of a watchglass fixing structure according to the present invention. In FIG. 20, reference numeral 80 a watchglass, 82 a synthetic resin ring, 84 a bezel, 86 a case band, and 88 a packing ring compressed between the bezel 84 and the case band 86. The bezel 84 has an annular recess 84*a* at its upper portion and an outer circumferential shoulder portion 84*b* for retaining a ring member 90. The ring member 90 includes a flange 90*a* which, together with the annular step 84*a* of the bezel 84, forms a channel-shaped annular recess when the ring member is fitted about the outer circumferential recess 84*a* of the bezel. The synthetic resin packing 82 is disposed in the annular recess formed by combining the bezel 84 and ring member 90, and the watchglass 80 is installed by pressing it into the packing from above. The watchglass 80 has an outer diametric portion 80*b* the height of the vertical portion of which is narrower than the width of the annular recess while the outer diameter of the watchglass is slightly shorter than the inner diameter of the flange, and also includes a lower inclined surface 80*c* at the portion below the outer diametric portion. The watchglass 80 is inserted into the annular recess while compressing the synthetic resin packing so that a compressed portion of the packing is caused to protrude from between the outer diametric portion 80*b* and flange 90*a* which defines a portion of the annular recess, whereby a protrusion 82*a* is formed on the upper inclined surface 80*a* of watchglass 80. Thus, the packing 82 is disposed in the annular recess defined by bezel 84 and ring member 90 and a portion of the packing undergoes plastic deformation owing to the insertion of the watchglass, thereby forming the protrusion 82*a* on the upper inclined surface 80*a* of the watchglass 80 in order to prevent the glass from falling out. Since only a small gap is defined between the outer diametric portion 80*b* of the watchglass and a watchglass guiding surface 90*c* on the flange 90*a* of ring member 90, the breaking strength of the protrusion 82*a* formed in said gap increases so that the watchglass is strongly retained and fixed. The small gap also facilitates the installation of the watchglass, as does an inclined surface 90*d* which is formed on the top surface of the flange 90*a*.

FIG. 21 shows another embodiment of the present invention in which the ring member 82 is press fitted and secured in the annular step 84*a* of the bezel 84. The bezel 84 has a flange 84*c* which facilitates the lathe work for the formation of the annular step. As in the embodiment of FIG. 20, the packing 82 is compressed by the outer diametric portion 80*b* of the watchglass and thus undergoes plastic deformation so that a portion of the packing is caused to protrude from the space formed by the outer diametric portion 80*b* and the flange 84*c* so as to form a protrusion 82*a* on the upper inclined surface 80*a* of the watchglass which is therefore prevented from falling out. In this embodiment, a ring member 92 is disposed in step 84*a* and interposed between the glass 80 and the annular shoulder 86*a* of case band 86 to provide a support for the glass 80 and ring 82.

Figure 23:
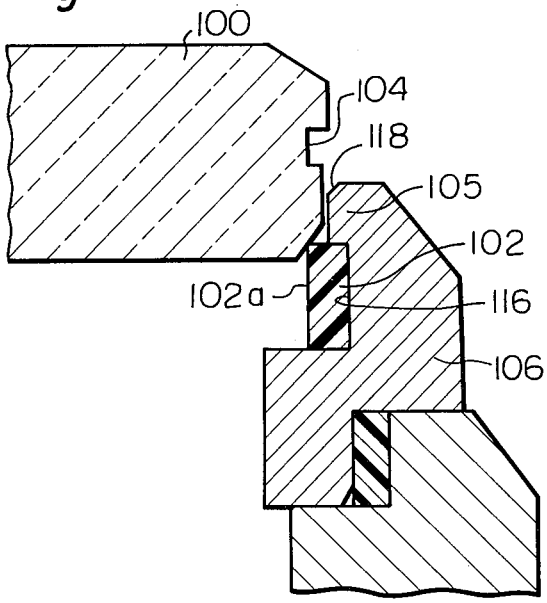
FIG. 23 is a cross section of the structure shown FIG. 22 during assembly.

FIGS. 22 and 23 show another preferred embodiment of a watchglass fixing structure according to the present invention. In FIG. 22, the outer circumference of watchglass 100 includes a substantially vertical outer diametric surface 100*a* below which is formed an inclined surface 100*b* that serves as a guide when the watchglass is inserted within synthetic resin ring 102. The outer diametric surface 100*a* of the watchglass is provided with a recess 104. The outer diameter $D_2$ of the outer diametric surface 100*a* is slightly less than the inner diameter $D_1$ of flange 105 of bezel 106 and is designed so as to compress the ring 102. The vertical portion 108 at the intersection of the outer diametric surface and upper inclined surface 110 is formed so that the distance $H_2$ from portion 108 to the bottom surface 112 of the watchglass is at a lower level than the inner surface 114 at the upper portion of annular recess 116, whereby a clearance C is formed between the inner surface 114 and the vertical portion 108. The point of intersection between the inclined guiding surface 100*b* and the bottom surface 112 of the watchglass is positioned further inward than the inner surface 102*a* of the synthetic resin ring 102. This prevents the edge of the watchglass from pulling the ring during the press fitting of the glass and mitigates the resistance offered by the glass.

The assembly proceeds as follows. As shown in FIG. 23, the synthetic resin ring 102 is disposed in the annular recess 116 of watchglass bezel 106. Once the watchglass is disposed at a position where it can be guided by flange 105 and inclined surface 118, the glass is pressed downward by means of a jig and comes into uniform pressured contact with the inner surface 102*a* of the ring 102, the glass being assisted by the flange 105 so as to approach from the correct position. Finally, as shown in FIG. 22, a portion of the synthetic resin 102 protrudes from the clearance C and forms the protrusion 120 in the recess 104, thereby greatly enhancing the force which fixes the watchglass 100. In addition, since the protrusion 120 is disposed in the recess 104, no part of the synthetic resin ring is visible from the outside.

Figure 24:
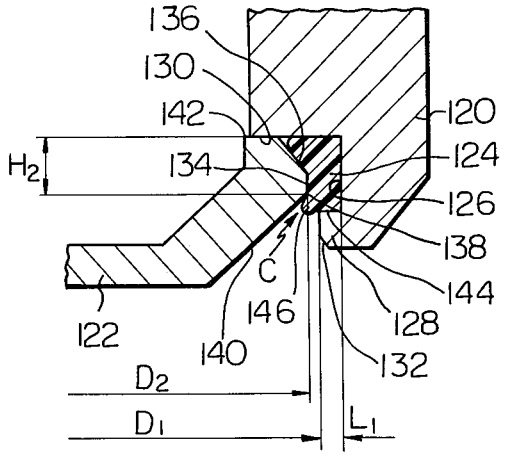
FIG. 24 is a cross section of another modification of the mounting structure for a timepiece according to the present invention.
Figure 25:
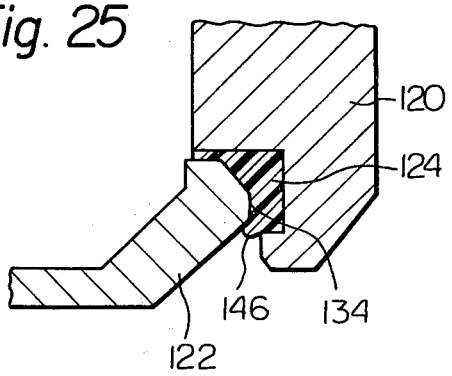
FIG. 25 shows a modification of the structure shown in FIG. 24.

FIGS. 24 and 25 are another embodiment according to the present invention. Reference numeral 120 denotes a case band which serves as a back cover fixing member, 122 a back cover, and 124 a synthetic resin ring. The inner circumferential surface of case band 120 is formed to include an annular recess 126 for accommodating the synthetic ring 124. The lower portion of the annular recess 126 includes a flange 128 for compressing the ring 124, and the upper portion includes a back cover seating surface 130 for seating the top surface of the back cover 122. The lower surface of flange 128 is formed to include an inclined surface 132 which facilitates the installation of the back cover 122. The depth $L_1$ of the annular recess 126 is approximately equal to the amount of inward protrusion of the compressed portion of the synthetic resin ring, and the inner diameter $D_1$ of flange 128 is slightly greater than the outer diameter $D_2$ of back cover 122 in order to serve as a guide when installing the back cover.

Meanwhile, the outer circumference of back cover 122 includes a substantially vertical outer diametric surface 134 above which is formed an inclined surface 136 that serves as a guide when the back cover is inserted within the synthetic resin ring. The vertical portion 138 at the intersection of the outer diametric surface and lower inclined surface 140 is formed so that the distance $H_2$ from portion 138 to the top surface 142 of the back cover 122 is at a higher level than the lower surface 144 of the annular recess 126, whereby a clearance C is formed between the lower inner surface 144 and the vertical portion 138. The point of intersection between the inclined guiding surface 136 and the top surface 142 of the back cover is positioned further inward than the inner surface of the synthetic resin ring.

This prevents the edge of the back cover from pulling the ring during the press-fitting of the back cover and mitigates the resistance offered by the back cover.

Figure 26:
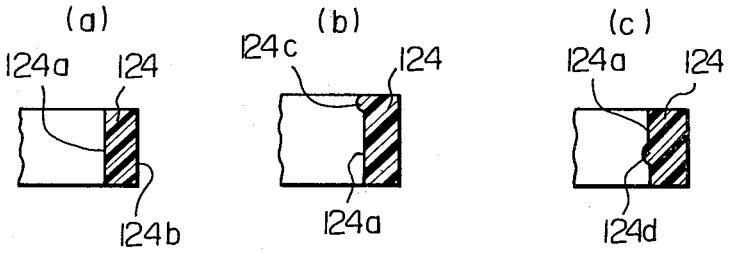
FIG. 26 shows examples of a synthetic resin ring for the structure shown in FIGS. 24 and 25.
Figure 27:
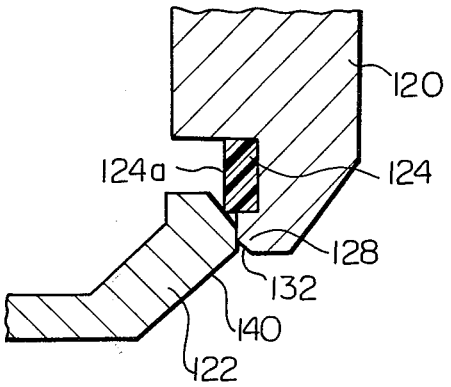
FIG. 27 is a cross section of the structure shown in FIG. 25 during assembly.

In FIG. 26(*a*) the synthetic resin ring 124 has an I-shaped cross-section prior to assembly. The inward side of the ring includes an inner surface 124*a* which is compressed by the outer diametric surface 134 of the back cover 122, while the outer side includes an outer surface 124*b* which contacts the bottom of the annular recess 126 of the case band 120. The height of the ring in this case is the same as or slightly lower than that of the annular groove. Shown in FIG. 26(*b*) is a synthetic resin ring 124 the upper portion of which is equipped with a bulge 124*c* adapted to creep under the inclined guiding surface 136 of the back cover 122. FIG. 26(*c*) shows another example in which the inner surface 124*a* of the ring is provided with a buldge 124*d*.

The synthetic ring 124 is forcibly compressed in the space defined by the annular recess 126, outer diametric surface 134 and inclined guiding surface 136. Owing to the plasticity of the resin, the entire space is filled to ensure a waterproof state and provide the fixing force for the back cover. Further, the intense volume compression causes a portion of the synthetic resin ring 124 to protrude from the clearance C and form a protrusion 146, the lower inclined surface 140 of the back cover being pressed in the upward direction.

The assembly proceeds as follows. As shown in FIG. 23, the synthetic resin ring 124 is disposed in the annular recess 126 of case band 120. Once the back cover is disposed at a position where it can be guided by flange 128 and inclined surface 132, the cover is pressed upward by means of a jig and comes into uniform pressured contact with the inner surface 124*a* of the ring 124, the back cover being assisted by the flange 128 so as to approach from the correct position. Finally, as shown in FIG. 24, a portion of the synthetic resin ring 124 protrudes from the clearance C and forms the protrusion 146 on the lower inclined surface 140, thereby greatly enhancing the force which fixes the back cover.

Since the embodiments shown in FIGS. 24 and 25 provide a structure wherein a synthetic resin ring is forcibly compressed between a back cover and the annular recess of a fixing member such as a case band so that a portion of the ring protrudes from a clearance between the back cover and annular groove to form a protrusion, the force which fixes the back cover and the water-tight seal between the back cover and its fixing member can both be greatly enhanced. On the other hand, the structure of the prior art merely compressed a synthetic ring in the diametric direction, so that much of the fixing force is lost due to deformation in the upward direction. In order to maintain the fixing force and water-tight seal at this portion, it is necessary to increase the thickness of the back cover or adopt a camfer structure. The present invention, however, adopts a completely different structure in which the synthetic resin ring is forcibly compressed in an annular recess which further gives rise to a deformed portion that is squeezed out of a clearance to form a protrusion on the lower inclined surface of the back cover. Fixing force and waterproofness superior to that of the prior art can therefore be obtained even when using an extremely small ring and a thin back cover. The structure of the present invention accordingly sufficiently meets the demand for thinner, more compact modern watch cases.

What is claimed is:

1. A structure for fixing a watchglass of a watch case, comprising:

a watchglass fixing member having an annular recess, a flange formed at an upper portion of said recess and having an inner diameter, and a watchglass seating surface formed at a lower portion of said recess;

a watchglass having an outer diametric surface formed with a vertical portion having a height less than the height of an inner surface at the upper portion of said annular recess while the outer diameter of the watchglass is slightly less than the inner diameter of said flange, an inclined guiding surface at a portion below said outer diameteric surface and a recess provided in said diametric surface; and a synthetic resin ring sandwiched between said annular recess and said watchglass and having a protrusion formed when said watchglass is press fitted into said synthetic resin ring, said protrusion engaging the recess of said watchglass to retain the same in a fixed position.

2. A structure for fixing a watchglass of a watch case, comprising:

a watchglass fixing member having an annular recess, a flange formed at an upper portion of said recess and having an inner diameter, a watchglass seating surface formed at a lower portion of said recess, and a stepped portion formed at a portion below said seating surface;

an inner ring member disposed in the stepped portion of said watchglass fixing member;

a watchglass having an outer diametric surface formed with a vertical portion having a height less than the height of an inner surface at the upper portion of said recess while the outer diameter of the watchglass is slightly less than the inner diameter of said flange, and an inclined guiding surface formed at a portion below said outer diametric surface; and a synthetic resin ring sandwiched between said annular recess and said watchglass and having a protrusion formed between said flange and the vertical portion of said watchglass when said watchglass is press fitted into said synthetic resin ring to retain said watchglass in a fixed position;

said watchglass and said synthetic resin ring seating on said inner ring member.

3. A structure for fixing a watchglass of a watch case, comprising:

a watchglass fixing member including an inwardly facing annular recess having an inner surface formed at an upper end of said recess and a bottom wall continuous with said inner surface, a flange formed at an upper portion of said recess and having a radially facing inner surface, and a radially extending watchglass seating surface formed at a lower portion of said recess;

a watchglass having an outer diametric surface formed with a vertical portion having a height less than the height of the inner surface of said annular recess, the watchglass being slightly less in diameter than the radially facing inner surface of said flange, an inclined guiding surface formed at a portion below said outer diametric surface, and an upper inclined surface formed at a portion above said outer diametric surface to define a space relative to said radially facing inner surface of said flange; and a synthetic resin ring including an intermediate portion sandwiched between the bottom wall of said annular recess and the vertical portion of said watchglass, a lower end portion sandwiched between the inclined guiding surface of said watchglass and said watchglass seating surface of said watchglass fixing member, and an upper portion engaging the inner surface of said annular recess and including a protrusion protruding into the space between said radially facing inner surface of said watchglass fixing member and said upper inclined surface of said watchglass, said protrusion and said lower portion of said ring engaging the upper inclined surface and the inclined guiding surface of said watchglass, respectively, to retain said watchglass in a fixed position relative to said watchglass fixing member.

4. A structure as claimed in claim 3, in which said inner surface of said annular recess comprising an inclined surface.

5. A structure for fixing a watchglass of a watch case, comprising:

a watchglass fixing member having an annular recess, a flange formed at an upper portion of said recess and a watchglass seating surface formed at a lower portion of said recess;

a watchglass having an outer diametric surface formed with a vertical portion, an inclined guiding surface at a portion below said outer diametric surface and an outwardly directed ringshaped recess formed at the outer diametric surface of said watchglass;

a synthetic resin ring sandwiched between said annular recess and said watchglass and having a protrusion formed when said watchglass is press fitted into said synthetic resin ring, said protrusion engaging the ring-shaped recess of said watchglass to retain said watchglass in a fixed position relative to said watchglass fixing member.

6. A structure for fixing a watchglass of a watch case, comprising:

a watchglass fixing member having an annular recess, a flange formed at an upper portion of said recess and a stepped portion formed at a position below said recess of said watchglass fixing member;

a watchglass seating ring fitted to said stepped portion;

a watchglass having an outer diametric surface formed with a vertical portion, and an inclined guiding surface at a portion below said outer diametric surface, said watchglass seating on said watchglass seating ring; and a synthetic resin ring sandwiched between said annular recess and said watchglass and having a protrusion formed when said watchglass is press fitted into said synthetic resin ring to retain said watchglass in a fixed position relative to said watchglass fixing member.

7. A structure for fixing a watchglass of a watch case, comprising:

a watchglass fixing member including an inwardly facing annular recess having an inner surface formed at an upper end of said recess and a bottom wall continuous with said inner surface, a flange formed at an upper portion of said recess and having a radially facing inner surface, and a radially extending seating surface formed at a lower portion of said recess;

a watchglass having an outer diametric surface formed with a vertical portion having a height less than the height of the inner surface of said annular recess, the watchglass being slightly less in diameter than the radially facing inner surface of said flange, an inclined guiding surface formed at a portion below said outer diametric surface, an upper inclined surface formed at a portion above said outer diametric surface to define a space relative to said radially facing inner surface of said flange, and a radially extending lower surface; and a synthetic resin ring including an intermediate portion sandwiched between the bottom wall of said annular recess and the vertical portion and the inclined guiding surface of said watchglass, a lower end portion sandwiched between the lower surface of said watchglass and said seating surface of said watchglass fixing member, and an upper portion engaging the inner surface of said annular recess and including a protrusion protruding into the space between said radially facing inner surface of said watchglass fixing member and said upper inclined surface of said watchglass, said lower end portion and said upper portion of said synthetic resin ring retaining said watchglass in a fixed position away from said watchglass fixing member.

8. A structure for fixing a watchglass of a watch case, comprising:

a watchglass fixing member including a bezel having an outwardly directed annular recess and an inwardly directed annular recess having a radially inwardly facing bottom wall and a watchglass seating surface radially and inwardly extending from said bottom wall, and a ring member fitted to said outwardly directed annular recess, said ring member including a radially inwardly extending flange portion having a radially extending inner surface located at an upper portion of said inwardly directed annular recess, and a radially facing inner surface;

a watchglass having an outer diametric surface formed with a vertical portion having a height less than the height of the radially facing inner surface of said ring member, the watchglass being slightly less in diameter than the radially facing inner surface of said ring member, an inclined guiding surface formed at a portion below said outer diametric surface, and an upper inclined surface formed at a portion above said outer diametric surface to define a space relative to said radially facing inner surface of said ring member; and a synthetic resin ring including an intermediate portion sandwiched between the bottom wall of said inwardly directed recess and the vertical portion of said watchglass, a lower end portion sandwiched between the inclined guiding surface of said watchglass and said watchglass seating surface of said watchglass fixing member, and an upper portion engaging the radially extending inner surface of said ring member and including a protrusion protruding into the space between said radially facing inner surface of said ring member and said upper inclined surface of said watchglass, said upper portion of said ring engaging the upper inclined surface of said watchglass to retain said watchglass in a fixed position.

9. In a structure for fixing a back cover on a watch case having a case band, the improvement comprising:

said case band including an inwardly facing annular recess having an inner surface formed at a lower end of said recess and a bottom wall continuous with said inner surface, a flange formed at a lower portion of said recess and having a radially facing inner surface, and a radially extending seating surface formed at an upper portion of said recess;

a back cover having an outer diametric surface formed with a vertical portion having a height less than the height of the inner surface of said annular recess, the back cover being slightly less in diameter than the radially facing inner surface of said flange, an inclined guiding surface formed at a portion above said outer diametric surface, and a lower inclined surface formed at a portion below said outer diametric surface to define a space relative to said radially facing inner surface of said flange;

a synthetic resin ring including an intermediate portion sandwiched between the bottom wall of said annular recess and the vertical portion of said back cover, an upper end portion sandwiched between the inclined guiding surface of said back cover and said seating surface of said case band, and a lower portion engaging the inner surface of said annular recess and including a protrusion protruding into the space between said radially facing inner surface of said flange and said lower inclined surface of said back cover, said lower portion of said synthetic resin ring engaging the lower inclined surface of said back cover to retain said back cover in a fixed position relative to said case band.

* * * * *